US006795021B2

(12) United States Patent
Ngai et al.

(10) Patent No.: US 6,795,021 B2
(45) Date of Patent: Sep. 21, 2004

(54) TUNABLE MULTI-BAND ANTENNA ARRAY

(75) Inventors: Eugene C. Ngai, Northboro, MA (US); Paul A. Theophelakes, Tewksbury, MA (US); Richard J. Cotillo, Boxborough, MA (US); Dennis J. Blejer, Sudbury, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/086,305

(22) Filed: Mar. 1, 2002

(65) Prior Publication Data

US 2003/0164797 A1 Sep. 4, 2003

(51) Int. Cl.[7] ..... H01Q 1/38
(52) U.S. Cl. ..... 343/700 MS; 343/841
(58) Field of Search ..... 343/700 MS, 841, 343/846

(56) References Cited

U.S. PATENT DOCUMENTS

| | | | | | |
|---|---|---|---|---|---|
| 4,460,894 | A | | 7/1984 | Robin et al. | 343/700 MS |
| 4,697,189 | A | * | 9/1987 | Ness | 343/700 MS |
| 4,783,661 | A | * | 11/1988 | Smith | 343/700 MS |
| 4,870,426 | A | | 9/1989 | Lamberty et al. | |
| 4,973,972 | A | | 11/1990 | Huang | 343/700 MS |
| 5,124,733 | A | * | 6/1992 | Haneishi | 343/700 MS |
| 6,218,989 | B1 | * | 4/2001 | Schneider et al. | 343/700 MS |

FOREIGN PATENT DOCUMENTS

| | | |
|---|---|---|
| EP | 0045254 | 2/1982 |
| EP | 0720252 | 7/1996 |
| FR | 2650442 | 2/1991 |
| JP | 60018004 | 1/1985 |

OTHER PUBLICATIONS

Krzysztofik, W.J., Kurowski, K. and Langoeski, Z.; "Stacked Rectangular Ring Antenna for GPO Mobile Receiver;" Antennas and Propagation Conference; IEEE, Mar. 30–Apr. 2, 1993; pp. 194–197.

Lee, Choon Sae, Nalbandian, Vahakn and Schwering, Felix; "Surface–Mode Supression in a Thick Microstrop Antenna by Parasitic Elements;" Microwave and Optical Technology Letters, vol. 8, No. 3, Feb. 20, 1995; pp. 145–146.

Padros, Neus, Ortigosa, Juan I., Baker, James, Iskander, Magdy F. and Thornberg, Bryce; "Comparative Study of High–Performance GPS Receiving Antenna Designs;" IEEE Transactions on Antennas and Propagation, vol. 45, No. 4, Apr. 1997; pp. 698–705.

Porter, Bradley, G., Noakes, Geoffrey B. and Gearhart, Steven S.; "Design of Dual–Band Dual–Polarized Wire Antennas Using a Genetic Algorithm;" IEEE International Symposium 1999. vol. 4; pp. 2706–2708.

(List continued on next page.)

*Primary Examiner*—Michael C. Wimer
(74) *Attorney, Agent, or Firm*—Daly, Crowley & Mofford, LLP

(57) ABSTRACT

An antenna element is provided having a stacked patch configuration and having tuning structures by which the antenna element can be tuned at two different frequencies of operation. A plurality of the antenna elements can be combined to provide an antenna array. The antenna array can be provided having one or more surface wave surface wave control structures that isolate respective ones of the antenna elements from other respective ones of the antenna elements. The antenna element and/or the antenna array can be provided having RF feeds that can generate any pre-determined polarization.

23 Claims, 5 Drawing Sheets

OTHER PUBLICATIONS

Hoorfar, A., Girard, G. and Perotta, A.; "Dual Frequency Circularly Polarised Prosimity–Fed Microstrop Antenna;" Electronics Letters, 13$^{th}$ May 1999, vol. 35, No. 10; pp. 759–761.

McLean, J.S., LaCross, J., Casey, J.R., Guzman, E., Crook, G.E. and Foltz, H.D.; "Co–Located, Dual–Band, Multi–Function Antenna System for the GloMo Universal Modular Packaging System;" 9$^{th}$ Virginia Tech/MPRG Symposium on Wireless Personal Communications, Jun. 2–4, 1999; pages.

Rojas, R.G. and Lee, K.W.; "Surface Wave Control Using Nonperodic Parasitic Strips in Printed Antennas;" IEE Proc.–Microw. Antennas Propag., vol. 148, No. 1, Feb. 2001; pp. 25–28.

Clarricoats, P.J.B., Rahmat–Samii, Y. and Wait, J.R.; "Characteristics of Microstrop Patch Antennas;" IEE Electromagnetic Waves Series 28, Handbook of Microstrop Antennas, IEEE 1979, vol. 1, pp. 798–201.

PCT Search Report: Application No. PCT/US02/31999; International Filing Date Oct. 7, 2002.

* cited by examiner

TUNABLE MULTI-BAND ANTENNA ARRAY

STATEMENT REGARDING FEDERALLY SPONSORED RESEARCH

This invention was made with government support under Contract No. F19628-00-C-002 awarded by the United States Air Force. The government has certain rights in the invention.

CROSS REFERENCE TO RELATED APPLICATIONS

Not Applicable.

FIELD OF THE INVENTION

This invention relates generally to antennas and more particularly to an antenna element and an antenna array that can operate in two or more frequency bands.

BACKGROUND OF THE INVENTION

A variety of conventional antennas are used to provide operation over selected frequency regions of the radio frequency (RF) frequency band. Notably, stacked patch antenna arrays have been used to provide simultaneous operation in two or more RF frequency bands. Antenna array arrangements operating in two or more RF frequency bands can require complex mechanism and techniques to allow arrangements to be selectively tuned to the two or more frequency bands.

Existing stacked patch antenna elements that have been adapted to operated in two RF frequency bands sometimes use air gaps disposed between dielectric layers to tune each of the frequency bands. This technique provides dual-band stacked patch antenna elements for which fine tuning is very difficult. The technique also provides antenna elements that can achieve only a relatively small difference in the frequency between each of the two frequency bands. In contrast, some applications, for example global positioning system (GPS) applications, have two operating frequencies (designated herein as L1 and L2) that have relatively wide separation.

It will be recognized that a conventional GPS system provides L1 at 1575.42 MHz and L2 at 1227.60 MHz, each having a bandwidth of 24 MHz. An antenna that can provide a relatively large frequency separation is desirable.

Conventional antenna arrays are provided having a plurality of antenna elements. Coupling between respective ones of the plurality of elements can produce undesired antenna and system effects, for example, unwanted beam pattern behavior, and unwanted coupling between transmitting and receiving elements. Thus, it is desirable in an antenna array having a plurality of antenna elements to reduce the amount of coupling between respective ones of the plurality of antenna elements.

For GPS applications, microstrip antenna arrays have been provided having a plurality of microstrip elements. Conventional microstrip designs suffer from a relatively high amount of coupling due to surface wave interference between elements.

It would, therefore, be desirable to provide a multi-band antenna array arrangement, wherein respective antenna elements associated with each frequency band are selectively tunable, and wherein the frequency bands can have a relatively large frequency separation. It would be further desirable to provide a multi-band antenna array arrangement having a plurality of antenna elements that are electrically and electro-magnetically isolated from each other.

SUMMARY OF THE INVENTION

In accordance with the present invention, an antenna is provided having a substrate, a plurality of antenna elements disposed on one surface thereof, and a ground plane disposed on the other surface. A surface wave control structure is provided between antenna elements to decoupled the antenna elements from each other. The surface wave control structure has an apex that provides a sharp edge.

With this particular arrangement, antenna elements combined within an antenna array are greatly decoupled form each other. System performance, including beam pattern shape, are improved.

In accordance with another aspect of the present invention, an antenna is provided having one or more dual stacked patch assemblies, wherein each of the dual stacked patch assemblies is provided having an upper patch element and a lower patch element. One or more upper tuning structures are coupled between the upper patch element and the lower patch element. One or more lower tuning structures are coupled between the lower patch element and the ground plane. The upper and the lower tuning structures can be provided having a pre-determined orientation about the surface of the stacked patch.

With this particular arrangement, an antenna array is provided that can operate at two different frequencies wherein each frequency can be effectively and independently tuned. Furthermore, the two frequencies at which the antenna operates can be widely spaced.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Figure 1:
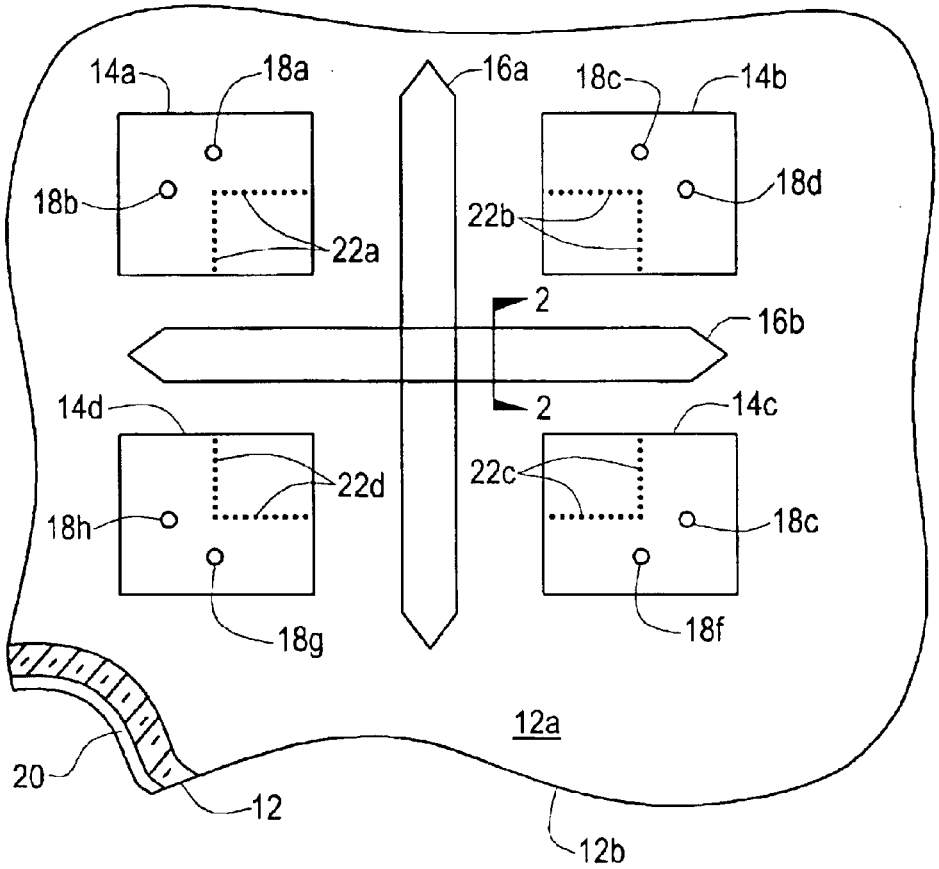
FIG. 1 is a top view of an exemplary patch antenna array in accordance with the present invention.

Referring now to FIG. 1, an antenna array 10 includes a substrate 12 having first and second opposing surfaces 12*a*, 12*b*. The substrate 12 is provided as a dielectric material such as fiberglass, PTFE, or the like. Disposed on the first surface of the substrate are a plurality of antenna elements 14*a*–14*d*. The elements 14*a*–14*d* are here shown as patch elements although other shaped elements (e.g. rectangular, round or even irregular shaped elements) may also be used.

First and second surface wave control structures 16*a*, 16*b* are disposed between the antenna elements 14*a*–14*d* to minimize the mutual coupling between the radiating elements 14*a*–14*d*. It should be appreciated that the surface wave control structures 16*a*, 16*b* must be provided from a conductive material (e.g. aluminum, copper, or any other appropriate material including electrical material which can be plated) and that the surface wave control structures 16*a*, 16*b* may be fabricated by machining or any other technique well known to those of ordinary skill in the art. A ground plane 20 is disposed over the second surface 12*b* of the substrate 12.

Antenna element feeds 18*a*–18*h* are provided as points to which RF signals can be applied to the antenna elements 14*a*–14*d*. Tuning structures, denoted as tuning structure groups 22*a*–22*d*, are provided to tune the antenna element. The antenna feeds 18*a*–18*h* and the tuning structures 22*a*–22*d* will be further described in association with FIG. 3.

While the surface wave control structures 16*a*, 16*b* are shown having a particular orientation with respect to the antenna elements 14*a*–14*d*, it should be appreciated that other orientations are possible with this invention. The surface wave control structures 16*a*, 16*b* can be oriented on the first surface 12*a* in any orientation that provides a reduction in the coupling between the antenna elements 14*a*–14*d*. Furthermore, while the surface wave control structures 16*a*, 16*b* are shown to be straight in the plane of the first surface 12*a*, in another embodiment, the surface wave control structure 16*a*, 16*b* can be curved upon the surface 12*a*. For example, the surface wave control structures 16*a*, 16*b* can be curved upon the surface 12*a* between antenna elements that are disposed in a circular pattern on the surface 12*a*, so as to provide a reduction in the coupling between the antenna elements.

While patch antenna elements 14*a*–14*d* are shown, it will be recognized that the surface wave control structures 16*a*, 16*b* can be applied to a variety of antenna element types. Also, while four patch antenna elements 14*a*–14*d* and two control structures 16*a*, 16*b* are shown, this invention applies equally well to two or more antenna elements and to one or more surface wave control structures. Furthermore, while eighteen tuning structures in each group 22*a*–22*d* are shown to be associated with each antenna element 14*a*–14*d*, it should be appreciated that this invention applies to one or more tuning structures associated with each antenna element 14*a*–14*d*.

It should be understood that, in some applications, antenna 10 can correspond to an antenna sub-assembly, or sub-array, and that a plurality of such antenna sub-assemblies can be disposed to provide an antenna.

Figure 2:
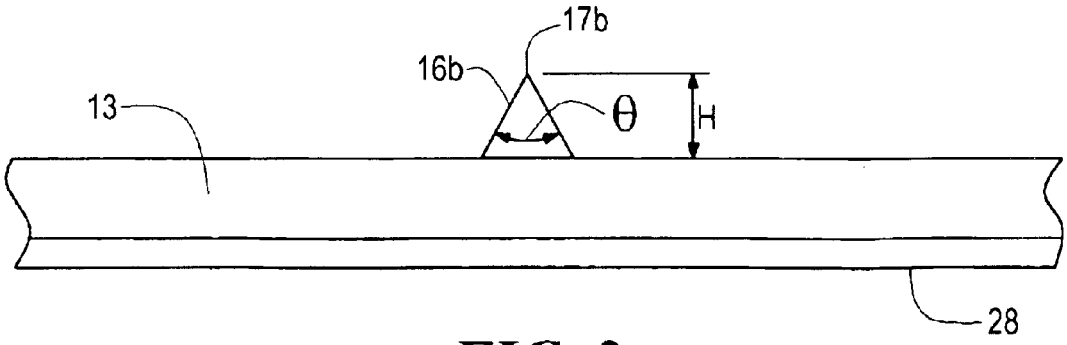
FIG. 2 is a cross section view of an exemplary surface wave surface wave control structure in accordance with the present invention.

Referring now to FIG. 2, in which like elements of FIG. 1 are provided having like reference designations, the surface wave control structure 16*b* is shown projecting above surface 12*a* by a height H and having an apex angle θ. In a particular embodiment where the array antenna operates at frequencies in the range of about 1 to 1.5 GHz, the surface wave control structure 16*b* is provided having a height H of 0.6 inches, and an apex angle θ of 12 degrees. In other embodiments, the height H can be in the range 0.1 to 1.0 inches, and the apex angle θ can be in the range of 5 degrees to 30 degrees.

The height H and apex angle a θ of the surface wave control structure are selected in accordance with a variety of factors, including but not limited to the antenna operating frequency, the separation, size and type of the antenna elements (e.g. antenna elements 14*a*–14*d* of FIG. 1), the relative orientation of the antenna elements, and the available height of the antenna.

Figure 3:
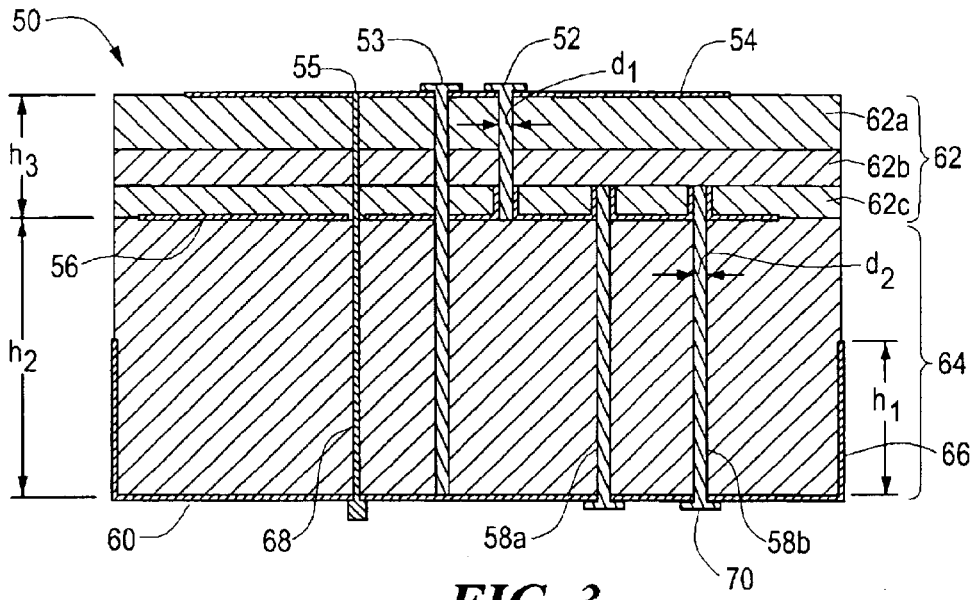
FIG. 3 is cross section view of an exemplary dual stacked patch antenna element having a tuning arrangement in accordance with the present invention.

Referring now to FIG. 3, an exemplary dual stacked patch antenna element 50 includes one or more upper tuning structures 52, each provided having a diameter d1, and a first and a second end coupled respectively to an upper patch element 54 and to a lower patch element 56. The antenna element 50 also includes one or more lower tuning structures 58*a*, 58*b*, each provided having a diameter d2, and a first and a second end coupled respectively to the lower patch element 56 and to a ground plane 60, for example, to the ground plane 20 of FIG. 1. One or more upper dielectric layers 62*a*–62*c* provide an isolation structure 62 between the upper patch element 54 and the lower patch element 56. The lower patch element 56 is disposed upon a first surface of the substrate 64, e.g. surface 12*a* of FIG. 1, and the ground plane 60 is disposed upon the second surface of the substrate 64, e.g. surface 12*b* of FIG. 1.

In one exemplary embodiment, the upper dielectric layer 62*a* is provided having a thickness of 60 mils and a dielectric constant of 2.94, the upper dielectric layer 62*b* is provided having a thickness of 30 mils and a dielectric constant of 2.2, the upper dielectric layer 62*c* is provided having a thickness of 10 mils and a dielectric constant of 2.94, and the substrate 64 is provided having a thickness of 310 mils and a dielectric constant of 2.94. In this particular embodiment, the upper tuning structure 52 and the lower tuning structures 58*a*, 58*b* are provided having a diameter of 32 mils. Also, in this particular embodiment, the upper patch element is square having sides of 2.216 inches and the lower patch element is square having sides of 2.580 inches.

A plated side wall 66, coupled to the ground plane 60, can be provided having an extension h1 in association with the substrate 64. A non-conductive center pin 53 can be provided to align the antenna. A feed pin 68 can provide an electrical coupling to the upper patch element 54 at a feed 55. Feed 55 corresponds to one of the feed points 18*a*–18*h* shown in FIG. 1. The upper patch element 54 and the lower patch element 56 can be provided having coupling features, of which coupling feature 70 is but one example, that provide a coupling to a respective end of the tuning structures, for example lower tuning structure 58*b*.

In one exemplary embodiment, the plated side wall extension h1 is 120 mils. While the plated side wall 66 is shown in association with a single antenna element 50, it should be appreciated that the plated side wall can be associated with a plurality of antenna elements, wherein the plated side wall 66 can be disposed around the outside circumferential edge of the substrate, for example substrate 12 of FIG. 1. The plated side wall 66 provides improved impedance matching, or coupling, of the type described below.

It will be recognized that, for this particular arrangement, the feed pin 68 provides a signal path to the upper patch element 54. In one particular embodiment, the upper patch element 54 has a first pre-determined capacitive and electromagnetic coupling at a first signal frequency to the lower patch element, and the lower patch element 56 has a second pre-determined capacitive and electro-magnetic coupling at a second signal frequency to the ground plane 60. At the first signal frequency, the lower patch element 56 is provided having a low impedance to the ground plane 60, and at the second signal frequency the upper patch element 54 is provided having a low impedance to the lower patch element 56. Thus, at the first signal frequency, the upper patch element 54 receives the first signal frequency from the feed 68 and the lower patch element 56 acts as a ground plane. Similarly, at the second signal frequency, the lower patch element 56 receives the second signal frequency from the feed 68 by way of the low impedance coupling between the upper patch element 54 and the lower patch element 56, and the ground plane 60 acts as a ground plane. With this particular arrangement, the dual stacked patch antenna element 50 can operate at two RF frequencies.

The tuning structures 52, 58*a*, 58*b* provide selective antenna tuning. At the first signal frequency where the lower patch element 56 acts as a ground plane for the first patch element 54, the upper tuning structure 52 provides antenna tuning. At the second signal frequency where the ground plane 60 acts as a ground plane for the lower patch element 56, the lower tuning structures 58*a*, 58*b* provide antenna tuning.

The tuning of the upper patch element 54 at the first signal frequency is influenced by a variety of factors, including the number of the upper tuning structures 52, the placement of the upper tuning structures 52 about the upper patch element 54, the diameter d1 of the upper tuning structures 52, and the alignment of the upper tuning structures 52 with the feed 55 and with each other. The tuning of the lower patch element 56 at the second signal frequency is also influenced by a variety of factors, including the number of the lower tuning structures 58*a*, 58*b*, the placement of the lower tuning structures 58*a*, 58*b* about the lower patch element 56, the number of the lower tuning structure 58*a*, 58*b*, and the alignment of the lower tuning structures 58*a*, 58*b* with the feed 55 and with each other. The alignment of the tuning structures is described more fully below in association with FIG. 3A.

The upper and lower tuning structures 52, 58*a*, 58*b* can be provided in a variety of ways, including screws, rivets, plated through holes, or any electrically conductive structure. The diameters d1 and d2 can be equal or different. While the diameters d1, d2 are optimally within the range of 25 to 50 mils, other diameters d1, d2 can also be used with this invention.

With this particular arrangement, the tuning provided by the upper tuning structures 52 at the first signal frequency is essentially independent of the tuning provided by the lower tuning structures 58*a*, 58*b* at the second signal frequency. While a first and a second signal frequency have been described, it should be appreciated that the discussions herein apply equally well to a first frequency band and a second frequency band.

While one feed 55 is shown, it will be recognized that a variety of feeds to either or both of the upper patch element 54 and/or the lower patch element 56 can be provided with this invention. A variety of alternative patch and feed arrangements are shown below in association with FIGS. 4–4D.

Figure 3A:
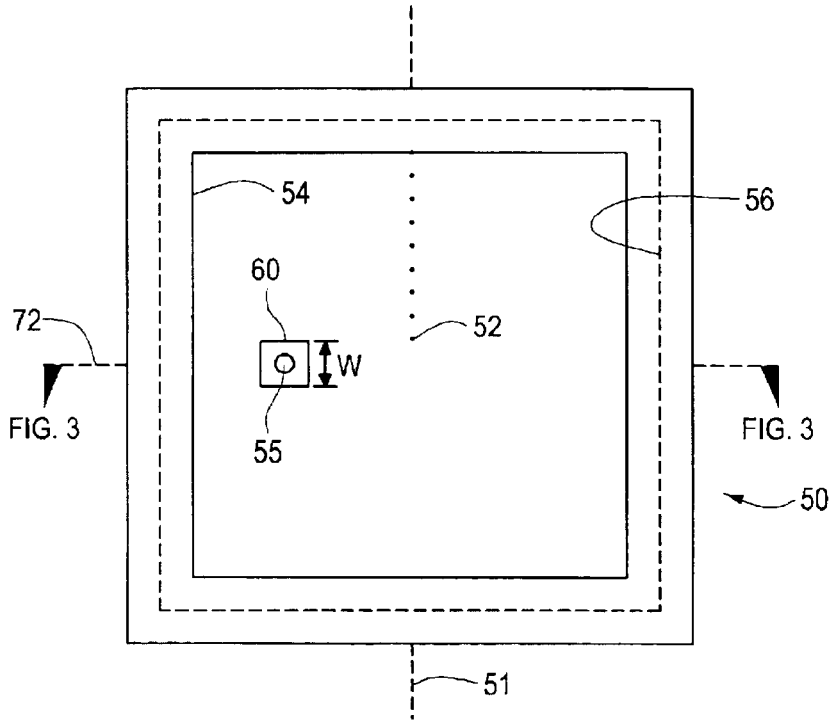
FIG. 3A is a top view of en exemplary dual stacked patch antenna element having a tuning arrangement in accordance with the present invention.

Referring now to FIG. 3A, in which like elements of FIGS. 2 and 3 are provided having like reference designations, the exemplary stacked patch antenna element 50 is provided having the upper patch element 54 smaller than the lower patch element 56. In one exemplary embodiment, the feed 55 is provided at a position that is generally along an axis 51 passing through the center of the stacked patch antenna element 50. In the exemplary embodiment, the tuning structures, of which upper tuning structure 52 is but one example, are generally aligned along the axis 51 upon which the feed 55 is aligned.

While a particular alignment of the feed 55 and the tuning structures, e.g. tuning structure 52, is shown, it should be appreciated that a variety of alignments can be provided in accordance with this invention. For example lower tuning structures (58*a*, 58*b*, FIG. 3) can be aligned along an axis 72. In accordance with the present invention, alignment of the feed and the tuning structures can be provided upon any axis disposed upon the antenna element 50. Also, no alignment need be provided.

While one upper patch feed 55 is shown, it will be recognized that more than one upper patch feed 55 can be provided in accordance with this invention. Multiple upper feeds may be desirable, for example, where circular polarization is desired.

Figure 4:
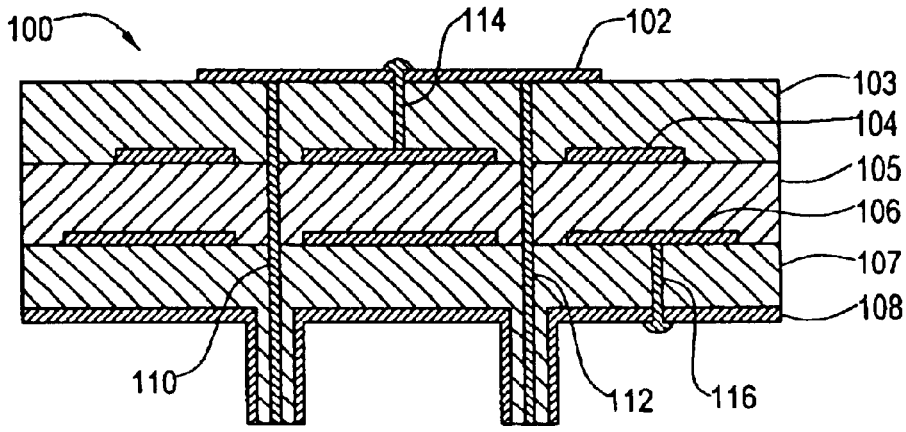
FIGS. 4–4D are cross section views of exemplary tuning arrangements in accordance with the present invention applied to a variety of stacked patch antenna elements.

Referring now to FIG. 4, an illustrative example of a triple stacked patch antenna element 100 is provided having an upper patch element 102, a middle patch element 104, and a lower patch element 106. An isolation structure 103 is disposed between the upper patch element 102 and the middle patch element 104. An isolation structure 105 is disposed between the middle patch element 104 and the lower patch element 106. A substrate 107 is disposed between the lower patch element 106 and a ground plane 108. A first upper patch feed 110 and a second upper patch feed 112 are coupled to the upper patch element 102.

The antenna element 100 includes one or more upper tuning structures 114, each having a first and a second end coupled respectively to the upper patch element 102 and the middle patch element 104. The antenna element 50 also includes one or more lower tuning structures 116, each provided having a first and a second end coupled respectively to the lower patch element 106 and to the ground plane 108.

Figure 4A:
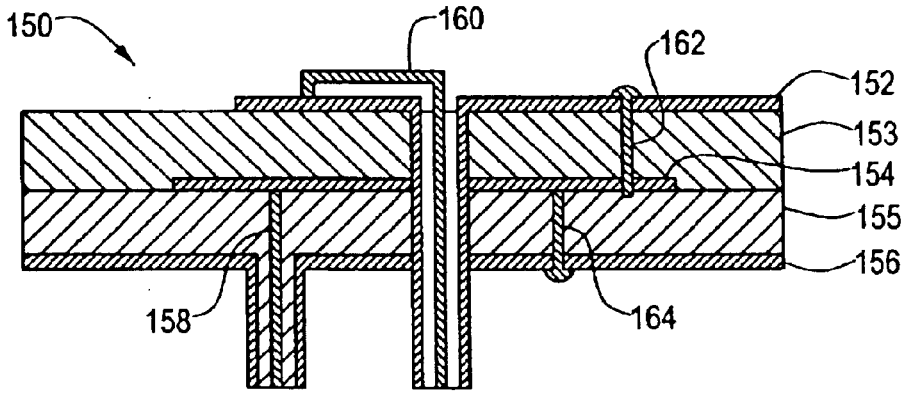

Referring now to FIG. 4A, an illustrative example of a dual stacked patch antenna element 150 is provided having an upper patch element 152, and a lower patch element 154. An isolation structure 153 is disposed between the upper patch element 152 and the lower patch element 154. A substrate 155 is disposed between the lower patch element 154 and a ground plane 156. A first upper patch feed 160 is coupled to the upper patch element 152, and a first lower patch feed 158 is coupled to the lower patch element 154.

The antenna element 150 includes one or more upper tuning structures 162, each having a first and a second end coupled respectively to the upper patch element 152 and the lower patch element 154. The antenna element 150 also includes one or more lower tuning structures 164, each provided having a first and a second end coupled respectively to the lower patch element 154 and to the ground plane 156.

Figure 4B:
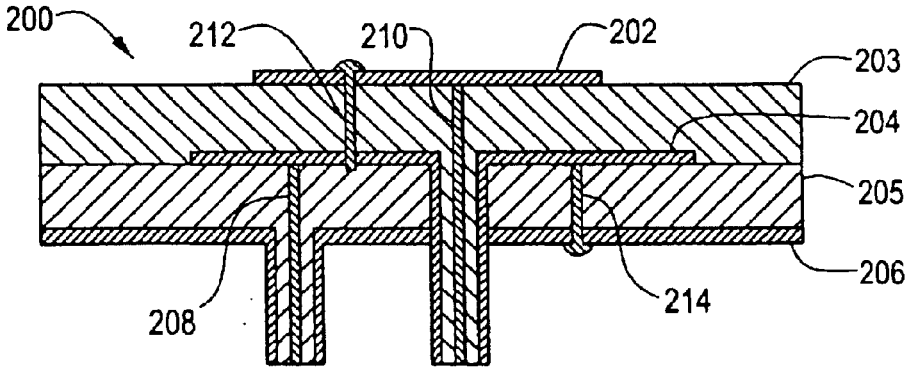

Referring now to FIG. 4B, another illustrative example of a dual stacked patch antenna element 200 is provided having an upper patch element 202, and a lower patch element 204. An isolation structure 203 is disposed between the upper patch element 202 and the lower patch element 204. A substrate 205 is disposed between the lower patch element 204 and a ground plane 206. An upper patch feed 210 is coupled to the upper patch element 202, and a lower patch feed 208 is coupled to the lower patch element 204.

The antenna element 200 includes one or more upper tuning structures 212, each having a first and a second end coupled respectively to the upper patch element 202 and the lower patch element 204. The antenna element 200 also includes one or more lower tuning structures 214, each provided having a first and a second end coupled respectively to the lower patch element 204 and to the ground plane 206.

Figure 4C:
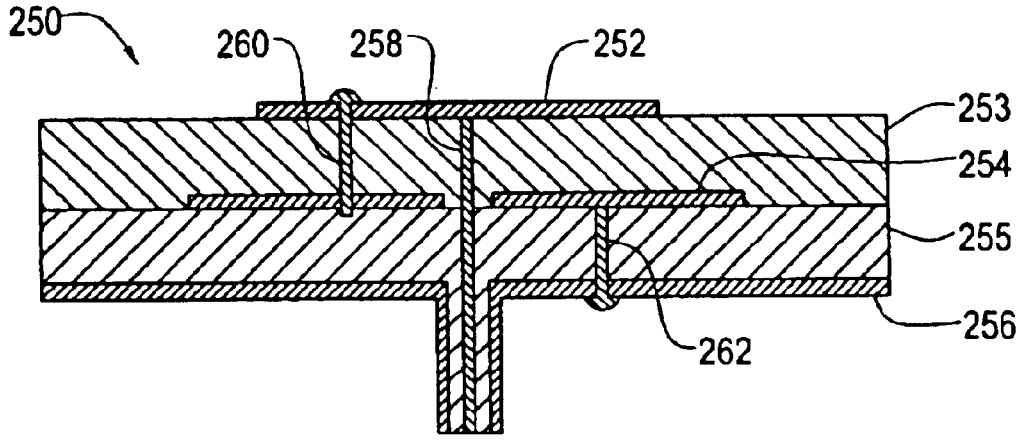

Referring now to FIG. 4C, yet another illustrative example of a dual stacked patch antenna element 250 is provided having an upper patch element 252, and a lower patch element 254. An isolation structure 253 is disposed between the upper patch element 252 and the lower patch element 254. A substrate 255 is disposed between the lower patch element 254 and a ground plane 256. An upper patch feed 258 is coupled to the upper patch element 252.

The antenna element 250 includes one or more upper tuning structures 260, each having a first and a second end coupled respectively to the upper patch element 252 and the lower patch element 254. The antenna element 250 also includes one or more lower tuning structures 262, each provided having a first and a second end coupled respectively to the lower patch element 254 and to the ground plane 256.

This particular embodiment will be recognized to correspond to the configuration described above in association with FIGS. 1–3.

Figure 4D:
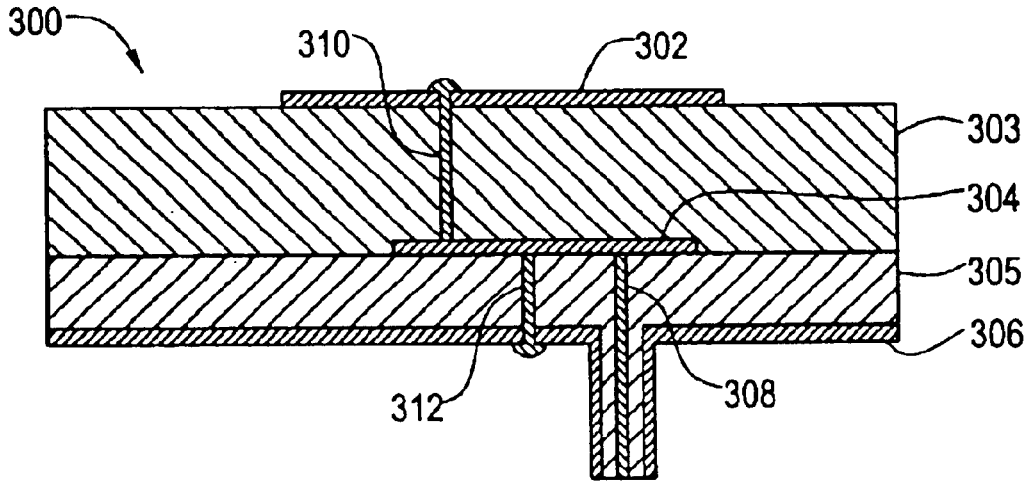

Referring now to FIG. 4D, yet another illustrative example of a dual stacked patch antenna element 300 is provided having an upper patch element 302, and a lower patch element 304. An isolation structure 303 is disposed between the upper patch element 302 and the lower patch element 304. A substrate 305 is disposed between the lower patch element 304 and a ground plane 306. An lower patch feed 308 is coupled to the lower patch element 304.

The antenna element 300 includes one or more upper tuning structures 310, each having a first and a second end coupled respectively to the upper patch element 302 and the lower patch element 304. The antenna element 300 also includes one or more lower tuning structures 312, each provided having a first and a second end coupled respectively to the lower patch element 304 and to the ground plane 306.

Figure 5:
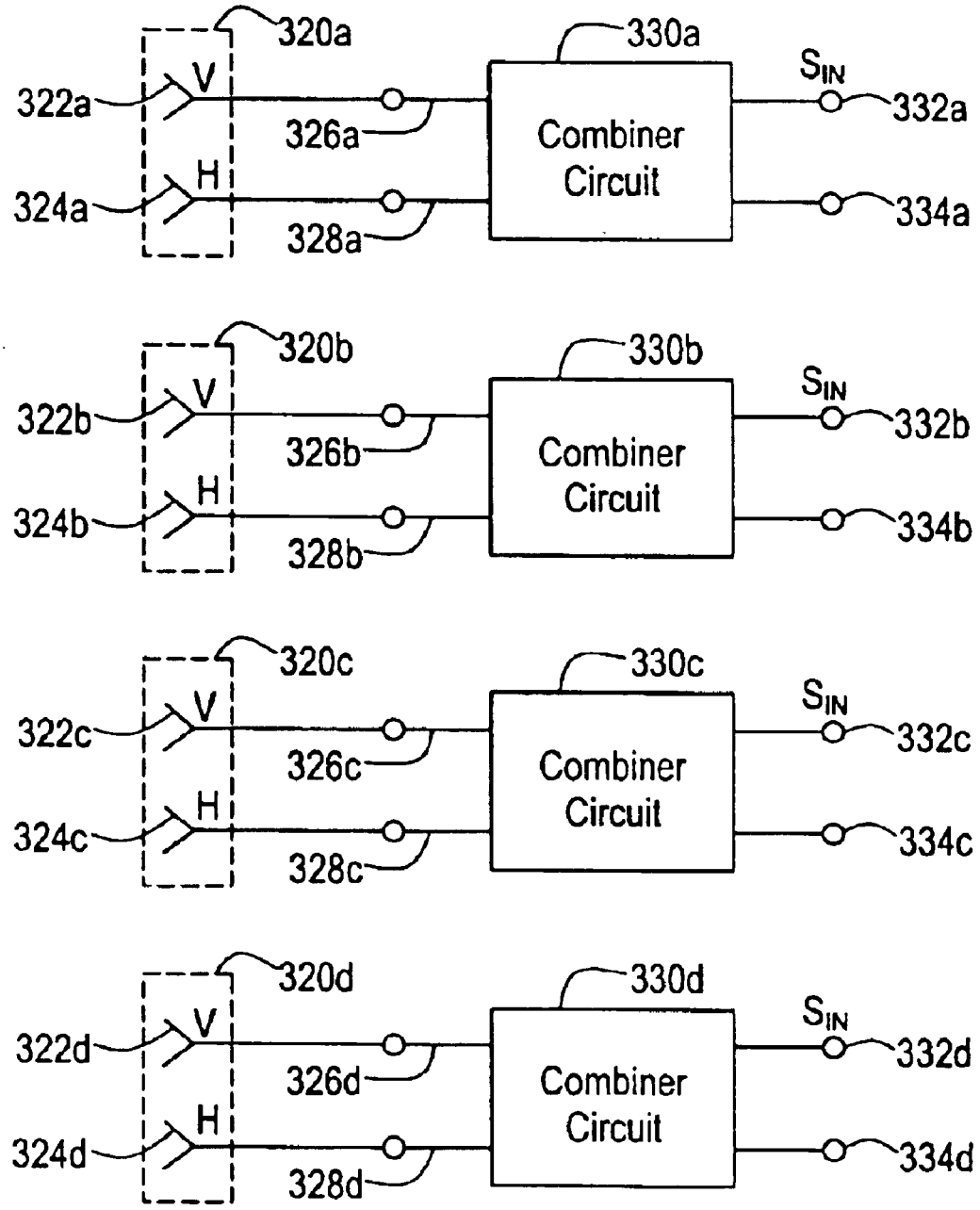
FIG. 5 is a schematic representation of a combiner circuit applied to the antenna array of FIG. 1.

Referring now to FIG. 5, a plurality of combiner circuits 330*a*–330*d* are coupled to a plurality of antenna elements 320*a*–320*d* at two feeds 322*a*–322*d* and 324*a*–424*d* respectively. Here, the antenna elements can be provided as dual stacked patch antenna elements as shown above in FIG. 1.

It should be appreciated that if an input signal, $S_{in}$, is applied to an input terminals, for example input terminal 332*a*, the combiner circuit 330*a* provides two corresponding feed signals 326*a*, 328*a* having a pre-determined phase relationship to each other. When the feed signals 326*a*, 328*a* are coupled to the antenna element 320*a* at feed points 322*a* and 324*a* respectively, emitted RF energy having a pre-determined transmit polarization will be generated by the antenna element 320*a*. Similarly, other antenna elements 320*b*–320*d* will emit RF energy having the pre-determined polarization. In one particular embodiment, the polarization is circular polarization.

While four antenna elements 320*a*–320*d* and four combiner circuits 330*a*–330*d* are shown, it should be understood that any number of antenna elements and combiner circuits can be used. Also, while a transmit circuit is shown, the same topology can apply equally well to a receive circuit, for which the input signals $S_{in}$, are replaced with output signals $S_{out}$.

Tuning structures described above can apply equally well to an antenna array having the pre-determined polarization. The surface wave control structures described above can also apply equally well to an antenna array having the pre-determined polarization.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. An antenna comprising:

a substrate having first and second opposing surfaces;

a plurality of antenna elements disposed on the first surface of said substrate;

a ground plane disposed on the second surface of said substrate; and at least one surface wave control structure disposed on the first surface of said substrate and between an adjacent pair of the plurality of antenna elements, said at least one surface wave control structure having a triangular cross section in a plane perpendicular to said substrate, having an apex at a distance between 0.1 and 1.0 inches above the first surface of said substrate and having an apex angle between 5 and 30 degrees.

2. The antenna of claim 1, wherein the intersection of the at least one surface wave control structure with the first surface of the substrate is a rectangle.

3. The antenna of claim 1 wherein the major axis of the at least one surface wave control structure has a pre-determined orientation angle with respect to a line connecting the centroids of the adjacent pair of the plurality of antenna elements.

4. The antenna of claim 3, wherein the orientation angle is such that the mutual coupling between the adjacent pair of antenna elements is reduced.

5. The antenna of claim 1, wherein the plurality of antenna elements are stacked patch antenna elements.

6. The antenna of claim 5, wherein the plurality of antenna elements corresponds to four antenna elements disposed as a four element array, and the at least one surface wave control structure corresponds to two surface wave control structures that are disposed to reduce the mutual coupling between each of the four antenna elements.

7. The antenna of claim 6 wherein the four element array and the two surface wave control structures correspond to an antenna sub-assembly, and the antenna comprises a plurality of the antenna sub-assemblies.

8. An antenna including one or more stacked patch assemblies, each having a first patch element adapted to couple with an isolation structure to a second patch element, the second patch element disposed on a first surface of a substrate, and a ground plane disposed on a second surface of the substrate, wherein the first surface of the substrate corresponds to a radiating surface, the antenna comprising:

one or more upper tuning structures having a first end in electrical contact with the first patch element and a second end in electrical contact with the second patch element; and one or more lower tuning structures having a first end in electrical contact with the second patch element and a second end in electrical contact with the ground plane, wherein said one or more upper tuning structures and said one or more lower tuning structures are disposed such that the one or more upper tuning structures can be used to tune the first patch element within a first frequency range and the one or more lower tuning structures can be used to tune the second patch element within a second frequency range wherein the tuning provided by a first one of the upper and lower tuning structures is substantially independent of the tuning provided by a second one of the upper and lower tuning structures.

9. The antenna of claim 8, wherein the upper and lower tuning structures are conductive screws.

10. The antenna of claim 8, wherein the upper and lower tuning structures are conductive vias.

11. The antenna of claim 8, wherein at least one of the upper and lower tuning structures comprises one or more respective conductive vias.

12. The antenna of claim 8, wherein the one or more stacked patch assemblies correspond to four stacked patch assemblies.

13. The antenna of claim 12, wherein the wherein the four stacked patch assemblies corresponds to an antenna sub-assembly, and a plurality of antenna sub-assemblies comprises an antenna array.

14. The antenna of claim 8, further comprising a first upper feed coupled to the first patch element, wherein the upper tuning structures are disposed along an axis and the first upper feed is also disposed along the same axis.

15. The antenna of claim 14, further comprising a second upper feed coupled to the first patch element, wherein the lower tuning structures are disposed along an axis and the second upper feed is also disposed alone the same axis.

16. The antenna of claim 8, further comprising a first lower feed coupled to the second patch element, wherein the lower tuning structures are disposed along an axis and the first lower feed is also disposed along the same axis.

17. The antenna of claim 16, further comprising a second lower feed coupled to the second patch element, wherein the upper tuning structures are disposed along an axis and the second lower feed is also disposed along the axis.

18. The antenna of claim 8, further comprising an upper feed coupled to the first patch element, wherein the upper tuning structures are disposed along an axis and the upper feed is also disposed along the same axis.

19. The antenna or claim 18, further comprising a lower feed coupled to the second patch element, wherein the lower tuning structures are disposed along an axis and the lower feed is also disposed along the same axis.

20. The antenna of claim 8, wherein the first and second patch elements are provided having one of:

a) a square shape, b) a round shape, and c) a rectangular shape.

21. The antenna of claim 8, further including a conductive sidewall coupled to the ground plane and disposed upon the circumference of the substrate.

22. The antenna of claim 8, further including one or more combiner circuits coupled to each respective one or more stacked patch assemblies to provide a pre-determined polarization.

23. The antenna of claim 12, further including at least one surface wave control structure disposed on a first surface of said isolation structure and between an adjacent pair of the one or more stacked patch assemblies, where said at least one surface wave control structure has a triangular cross section in a plane perpendicular to said substrate, and an apex at a pre-determined distance above the first surface of said substrate, wherein the apex has a pre-determined apex angle, wherein the apex is at a distance between 0.1 and 1.0 inches above the substrate, and the apex angle is between 5 and 30 degrees.

* * * * *

UNITED STATES PATENT AND TRADEMARK OFFICE

CERTIFICATE OF CORRECTION

PATENT NO. : 6,795,021 B2
DATED : September 21, 2004
INVENTOR(S) : Ngai et al.

It is certified that error appears in the above-identified patent and that said Letters Patent is hereby corrected as shown below:

Column 1,
Line 32, delete “operated” and replace with -- operate --.

Column 2,
Line 9, delete “decoupled” and replace with -- decouple --.
Line 13, delete “form” and replace with -- from --.
Line 46, delete “en” and replace with -- an --.

Column 3,
Line 58, delete “range 0.1” and replace with -- range of 0.1 --.
Line 61, delete “angle a Ø” and replace with -- angle Ø --.

Column 4,
Line 39, delete “provide” and replace with -- provides --.
Line 60, delete “frequency the” and replace with -- frequency, the --.

Column 5,
Line 65, delete “For example lower” and replace with -- For example, lower --.

Column 7,
Line 21, delete “An” and replace with -- A --.
Line 38, delete “terminals,” and replace with -- terminal, --.

Column 9,
Line 13, delete “wherein the wherein the four” and replace with -- wherein the four --.

Signed and Sealed this

Fifteenth Day of November, 2005

JON W. DUDAS
*Director of the United States Patent and Trademark Office*